US008113259B2

(12) United States Patent
Tessmer

(10) Patent No.: US 8,113,259 B2
(45) Date of Patent: Feb. 14, 2012

(54) SIDE SHADE FOR AN AWNING

(76) Inventor: Marvin Carl Tessmer, Grass Lake, MI (US)

( * ) Notice: Subject to any disclaimer, the term of this patent is extended or adjusted under 35 U.S.C. 154(b) by 0 days.

(21) Appl. No.: 12/818,436

(22) Filed: Jun. 18, 2010

(65) Prior Publication Data

US 2011/0308741 A1 Dec. 22, 2011

(51) Int. Cl.
*E04F 10/00* (2006.01)

(52) U.S. Cl. ..... 160/54; 160/47; 160/56; 160/57; 160/368.1; 160/368.2; 40/603; 40/604

(58) Field of Classification Search ..... 160/47, 160/57, 58.1, 56, 66, 70, 79, 368.2, 368.1, 160/327; 40/603, 604
See application file for complete search history.

(56) References Cited

U.S. PATENT DOCUMENTS

| | | | | | |
|---|---|---|---|---|---|
| 305,614 | A * | 9/1884 | Mallory | 160/22 |
| 565,192 | A * | 8/1896 | Waterhouse | 160/56 |
| 611,872 | A * | 10/1898 | Tabler | 160/58.1 |
| 1,279,585 | A * | 9/1918 | Pfefferkorn | 160/56 |
| 1,620,958 | A * | 3/1927 | Girton et al. | 160/65 |
| 1,677,581 | A * | 7/1928 | Cohen | 160/81 |
| 1,699,735 | A * | 1/1929 | Dabrohua et al. | 40/603 |
| 1,742,234 | A * | 1/1930 | Clifton | 160/70 |
| 1,804,634 | A * | 5/1931 | Meunier | 160/70 |
| 1,854,499 | A * | 4/1932 | Anton et al. | 160/56 |
| 2,520,625 | A * | 8/1950 | Dean | 160/57 |
| 2,583,824 | A * | 1/1952 | Dwinell et al. | 160/22 |
| 3,084,703 | A * | 4/1963 | Lefebvre et al. | 135/91 |
| 3,149,665 | A * | 9/1964 | Handford | 160/327 |
| 4,102,353 | A * | 7/1978 | Pugliese | 52/16 |
| 4,175,576 | A * | 11/1979 | Iby | 135/88.1 |
| 4,301,851 | A * | 11/1981 | Gitkin | 160/46 |
| 4,561,227 | A | 12/1985 | Austin | |
| 5,232,036 | A * | 8/1993 | Brutsaert | 160/70 |
| 5,718,253 | A * | 2/1998 | McNamee | 135/88.13 |
| 6,125,905 | A * | 10/2000 | Woodside et al. | 160/67 |
| 6,131,990 | A * | 10/2000 | Crean | 296/163 |
| 6,145,525 | A * | 11/2000 | Mooney | 135/119 |
| 6,260,909 | B1 * | 7/2001 | Crean et al. | 296/163 |
| 6,276,424 | B1 * | 8/2001 | Frey, Jr. | 160/67 |
| 6,484,739 | B1 | 11/2002 | Sofie et al. | |
| 6,584,928 | B2 * | 7/2003 | Kinahan | 116/174 |
| 7,100,625 | B2 * | 9/2006 | Valles | 135/88.13 |
| 7,424,864 | B2 * | 9/2008 | McCann | 116/174 |
| 7,437,843 | B2 * | 10/2008 | Lefebvre | 40/601 |
| 7,568,491 | B2 | 8/2009 | Banfill et al. | |
| 7,841,117 | B2 * | 11/2010 | Smith | 40/607.05 |
| 2008/0163563 | A1 | 7/2008 | Sciglia | |
| 2009/0050277 | A1 * | 2/2009 | Ito | 160/67 |

* cited by examiner

*Primary Examiner* — Blair M Johnson
*Assistant Examiner* — Marcus Menezes
(74) *Attorney, Agent, or Firm* — Raymond J. Vivacqua

(57) ABSTRACT

A side shade for an awning includes a mounting member having a top end, a bottom end, a hook at the top end and a vertical groove extending from the top end to the bottom end. The mounting member is removably connectable by the hook to the awning near an attachment support of the awning. At least a portion of a stiffening member and a first vertical side of the fabric panel are slidingly disposed within the vertical groove of the mounting member. When assembled and attached to the awning the fabric panel of the side shade is vertically adjustably positionable above or below a lateral side of a predominantly horizontal panel of the awning so that there is no vertical gap between the panel of the awning and the fabric panel of the side shade through which direct light can penetrate.

9 Claims, 4 Drawing Sheets

SIDE SHADE FOR AN AWNING

FIELD

The present invention relates to side shades for awnings and more particularly to a vertically adjustable, removable side shade system for a retractable awning.

BACKGROUND

The statements in this section merely provide background information related to the present disclosure and may or may not constitute prior art.

Retractable awnings have been in use for many years, both on buildings and on mobile structures such as such as recreational vehicles and mobile homes. Typically, a retractable awning includes a cloth panel awning sheet that is securely attached along one edge to a roller mounted on an axle. The axle is in turn attached to a mounting bracket attached to the building or mobile structure. An opposite edge of the cloth panel of the awning is securely attached to a projecting support bar. Scissor arms support the support bar as the support bar extends out and the cloth panel unrolls from the roller to the cloth panel's full projection. Generally the roller is mounted at a slightly higher elevation than the final elevation for the support bar, so the fully extended cloth panel projects out from the building or mobile structure at a slight downward angle. Retractable awnings not only provide shade and protection from the elements they can be retracted for storage during heavy winds and/or when one wants to move a movable structure with an attached awning.

However, retractable awnings only provide shade when the cloth panel of the awning is located between the sun and the area to be shaded. If the sun is high in the sky there is usually not a problem with the awning providing shade. However, when the sun is lower in the sky there can be a problem with the awning not providing suitable shade. For instance if the awning is mounted on a south-facing surface and the sun is low in the sky to the east (rising) or low in the sky to the west (setting) the cloth panel of the awning can be out of position and will not block the sun's rays.

There have been attempts to overcome this problem by adding side panels to a retractable awning. There are various forms of slidable curtains or panels that snap into place that have been disclosed. These curtains and snapped panels leave openings between the cloth panel of the awning and the side curtain/panel. These openings allow the sun's rays to penetrate below the awning. In addition these curtains and snapped panels are difficult to mount/assemble or disassemble. Since one cannot retract a retractable awning with these curtains or panels in place a side panel that is difficult to disassemble poses a problem when the winds rise quickly and one needs to retract the awning quickly. Finally, the curtains and snapped panels currently in use are cumbersome to store. Accordingly, there is a need for a side shade system that is easy to mount, easy to remove, easy to store and does not leave openings that allow the sun's rays to penetrate.

SUMMARY

The present invention provides a side shade system for an awning having a mounting member, a projected edge support and at least one lateral support between the mounting member and the projecting side. The side shade is operable to be vertically adjustably connected to the lateral support of the awning such that no vertical gap exists between the fabric panel and the at least one lateral support of the awning.

In one embodiment of the present invention the awning has a predominantly horizontal panel, an attachment support, a projected edge support and at least one lateral support. The side shade includes a fabric panel having a first vertical side and a stiffening member connected to the first vertical side of the fabric panel. A mounting member having a top end, a bottom end and a vertical groove extending between the top end to the bottom end is removably connectable to the awning near the attachment support of the awning. At least a portion of the stiffening member and the first vertical side of the fabric panel is slidingly disposed within the vertical groove of the mounting member. A locking member is also disposed in the vertical groove of the mounting member and is releasably connectable to the mounting member. When assembled and attached to the awning the fabric panel of the side shade is vertically adjustably positionable above or below a lateral side of the predominantly horizontal panel of the awning so that there is no vertical gap between the panel of the awning and the fabric panel of the side shade through which direct light can penetrate.

In another embodiment of the present invention the awning has a predominantly horizontal panel and an attachment support. The side shade includes a fabric panel having a first vertical side. A mounting member having a top end and is removably connectable to the awning near the attachment support of the awning. At least a portion of the first vertical side of the fabric panel is connected to a lateral support of the awning. When assembled and attached to the awning the fabric panel of the side shade is vertically adjustably positionable above or below a lateral side of the predominantly horizontal panel of the awning so that there is no vertical gap between the panel of the awning and the fabric panel of the side shade through which direct light can penetrate.

In another embodiment of the present invention the awning has a predominantly horizontal panel, an attachment support, a projected edge support and at least one lateral support. The side shade includes a fabric panel having a first vertical side, a second vertical side and a top portion. The second vertical side of the fabric panel is removably connectable to the awning near the projected edge support of the awning. A stiffening member is connected to the first vertical side of the fabric panel. A mounting member having a top end, a bottom end, a hook near the top end and a vertical groove extending between the top end to the bottom end is removably connectable to the awning by the hook near the attachment support of the awning. At least a portion of the stiffening member and the first vertical side of the fabric panel is slidingly disposed within the vertical groove of the mounting member. A locking member is also disposed in the vertical groove of the mounting member and is releasably connectable to the mounting member by a wing bolt. When assembled and attached to the awning the fabric panel of the side shade is vertically adjustably positionable above or below a lateral side of the predominantly horizontal panel of the awning so that there is no vertical gap between the panel of the awning and the fabric panel of the side shade through which direct light can penetrate.

In another the awning has a predominantly horizontal panel, an attachment support, a projected edge support and a pair of opposed lateral supports between the mounting member and the projecting side. A pair of support arms running along each of the lateral supports, respectively, supports the awning. The side shade includes a fabric panel having a first vertical side and a second vertical side and a stiffening member connected to and integral with the first vertical side of the fabric panel. A mounting member having a top end, a bottom end and a vertical groove from the top end to the bottom end is operative to be removably connected to either the first lateral support of the awning or the second lateral support of the awning near the attachment support of the awning. The first vertical side of the fabric panel slidingly engages within the vertical groove of the mounting member such that the first vertical side of the side shade can slide vertically up and down inside the groove. A locking member mechanism adjustably located in the vertical groove of the mounting member allows vertical adjustment of the first vertical side of the side shade within the vertical groove of the mounting member. When assembled and attached to the awning the fabric panel of the side shade is vertically adjustable in relation to the predominantly horizontal panel of the awning so that there is no vertical gap between the panel of the awning and the fabric panel of the side shade through which direct light can penetrate.

In another embodiment of the present invention the awning has a predominantly horizontal panel, an attachment support, a projected edge support and a pair of opposed lateral supports between the mounting member and the projecting side. A pair of support arms running along each of the lateral supports, respectively, supports the awning. The side shade includes a fabric panel having a first vertical side and a second vertical side and a stiffening member connected to and integral with the first vertical side of the fabric panel. A mounting member having a top end, a bottom end and a pulley attached near the top end is operative to be removably connected to either the first lateral support of the awning or the second lateral support of the awning near the attachment support of the awning. A cord having a first end and a second end is fitted through the pulley and the first end of the cord is connected to the first vertical side of the side shade such that pulling or releasing the second end of the cord allows the first vertical side of the side shade to be vertically adjusted in relation to the mounting member. When assembled and attached to the awning the fabric panel of the side shade is vertically adjustable in relation to the panel of the awning so that there is no vertical gap between the panel of the awning and the predominantly horizontal panel fabric panel of the side shade through which direct light can penetrate.

In another embodiment of the present invention the awning has a predominantly horizontal panel, an attachment support, a projected edge support and a pair of opposed lateral supports between the mounting member and the projecting side. A pair of support arms running along each of the lateral supports, respectively, supports the awning. A pulley is attached to the awning either on one of the support arms or on a connection for the awning to a support structure. The side shade includes a fabric panel having a first vertical side and a second vertical side and a stiffening member connected to and integral with the first vertical side of the fabric panel. The first vertical side of the side shade is connected to a mounting member. A cord having a first end and a second end is fitted through the pulley and the first end of the cord is connected to the mounting member such that pulling or releasing the second end of the cord allows the first vertical side of the side shade to be vertically adjusted in relation to the awning. When assembled and attached to the awning the fabric panel of the side shade is vertically adjustable in relation to the predominantly horizontal panel panel of the awning so that there is no vertical gap between the panel of the awning and the fabric panel of the side shade through which direct light can penetrate.

In another embodiment of the present invention the awning has a predominantly horizontal panel, an attachment support, a projected edge support and a pair of opposed lateral supports between the mounting member and the projecting side. A pair of support arms running along each of the lateral supports, respectively, supports the awning. The side shade includes a fabric panel having a first vertical side and a second vertical side and a stiffening member connected to and integral with the first vertical side of the fabric panel. The first vertical side of the side shade is connected to a mounting member. The mounting member is attached to the awning such that, when assembled and attached to the awning the predominantly horizontal panel fabric panel of the side shade prevents direct light from penetrating horizontally under the awning from the side of the awning to which the side shade is attached.

In another aspect of the present invention the awning is a retractable awning.

In yet another aspect of the present invention the fabric panel of the side shade can roll up around the mounting member for easy storage.

In still another aspect of the present invention the mounting member has a hook at an upper end to allow the mounting member to be removably mounted to the awning.

In still another aspect of the present invention the mounting member has a cord loop at an upper end to allow the mounting member to be removably mounted to the awning.

In still another aspect of the present invention the cord is connected to the side shade by a clip.

In still another aspect of the present invention the mounting member includes a cleat to secure the second end of the cord.

The above features and advantages and other features and advantages of the present invention are readily apparent from the following detailed description of the best modes for carrying out the invention when taken in connection with the accompanying drawings.

DRAWINGS

Figure 6:
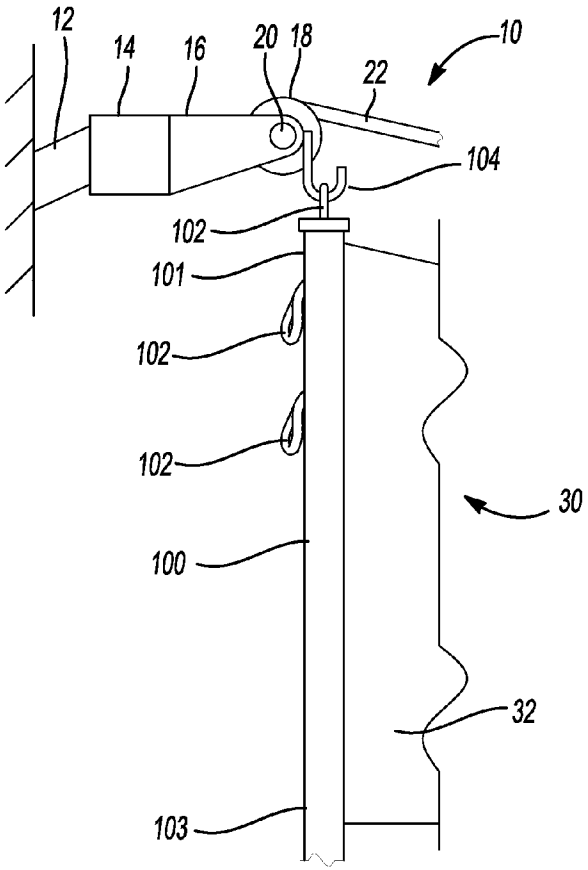
Figure 5:
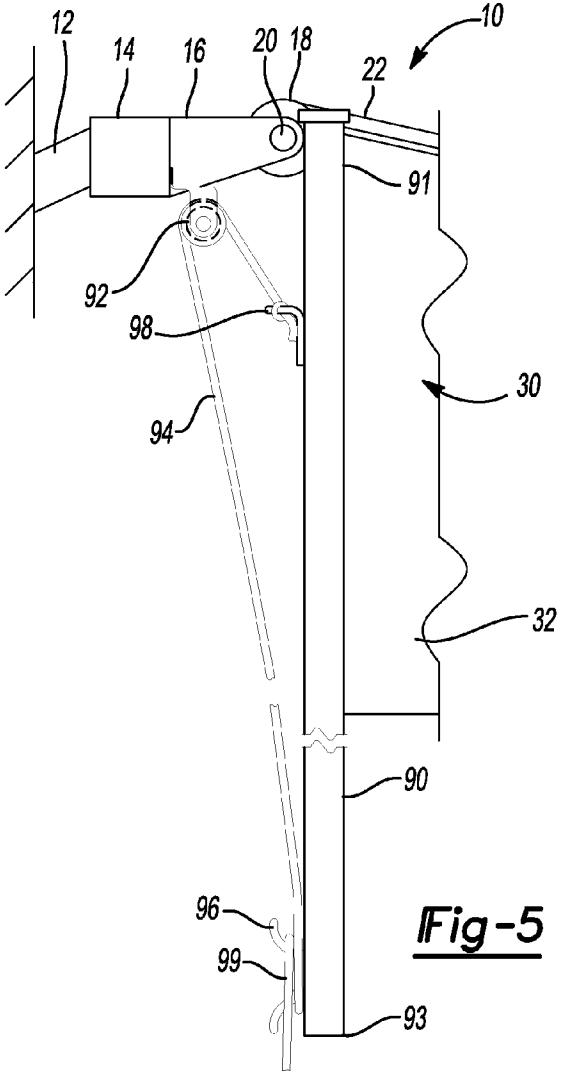

FIG. 5 is side view of yet another embodiment of a side shade in accordance with the present invention mounted on an awning showing just the portion of the side-shade and awning near the mounting portion of the awning; and FIG. 6 is side view of still another embodiment of a side shade in accordance with the present invention mounted on an awning showing just the portion of the side-shade and awning near the mounting portion of the awning.

DETAILED DESCRIPTION

Figure 1:
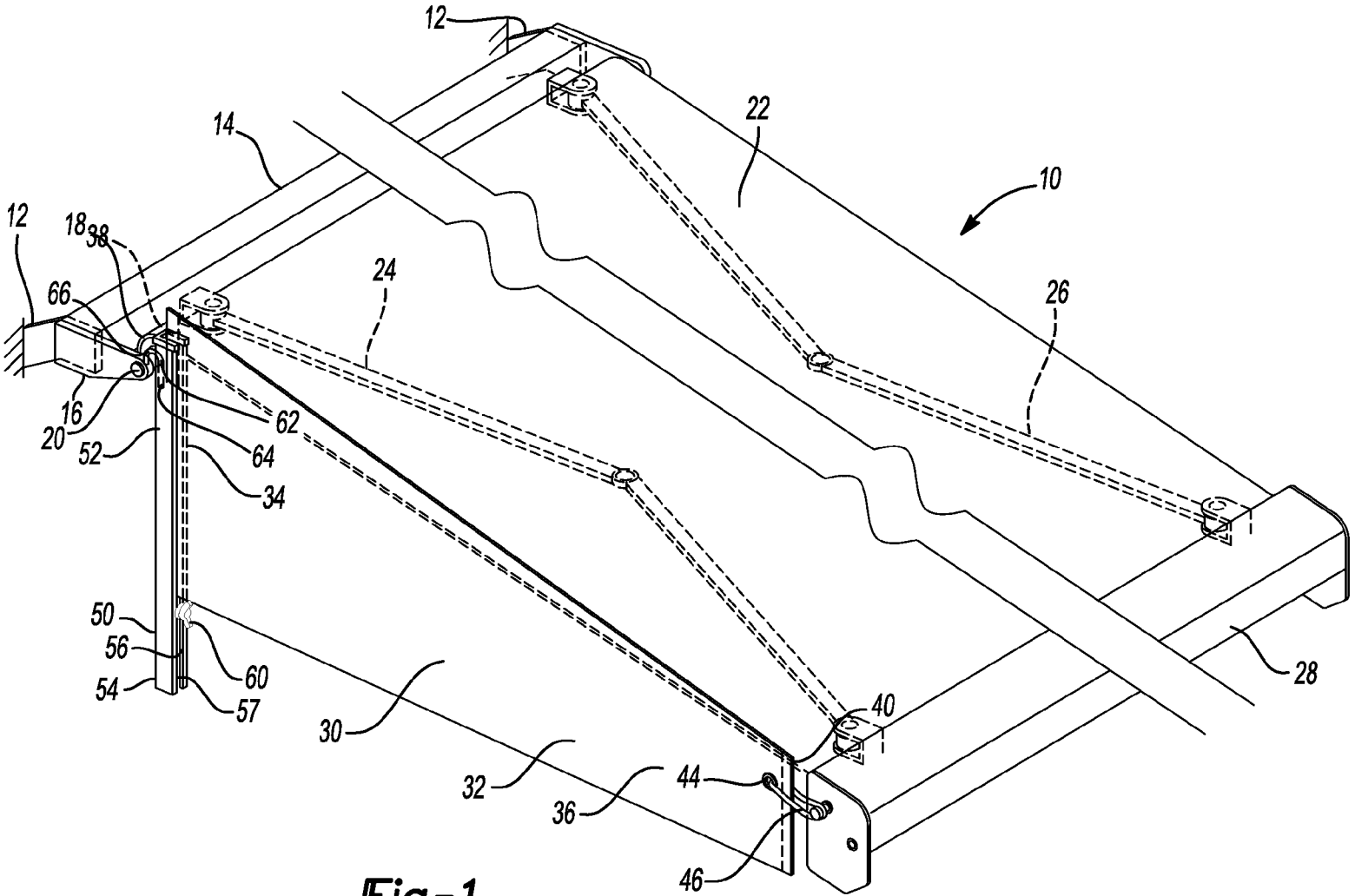
FIG. 1 is a perspective view of an awning and an embodiment of a side shade in accordance with the present invention.

Referring to the drawings, wherein like reference numbers refer to like components, in FIG. 1 an awning assembly is generally indicated by reference number 10. FIG. 1 depicts a retractable awning but the present invention can be used on any suitable awning assembly. The awning assembly 10 of FIG. 1 includes a plurality of mounting brackets 12, a torsion bar 14, at least two connecting brackets 16, and a spindle 18 on an axle 20. The awning assembly also includes a fabric panel 22, first and second scissor support arms 24 and 26, respectively, and a projected edge support 28. The awning attachment support has the mounting brackets 12 attached to a suitable mounting structure and fixedly connected to the torsion bar 14. The axle 20 connects to the torsion bar 14 by the connecting brackets 16 and the spindle 18 is able to spin on the axle 20. The first and second scissor support arms 24 and 26 are connected at one end each to the mounting brackets 12 and at the other end each to the projected edge support 28. The fabric panel 22 is attached at one end to the spindle 18 and at another end to the projected edge support 28. When the awning is in the retracted, stored position the fabric panel 22 is rolled on the spindle 18, the first and second scissor support arms 24 and 26 are scissored and folded and the projected edge support 28 is retracted close to the spindle.

To deploy the fabric panel 22 and extend the awning assembly 10, an operator would engage an electric motor (not shown) or use a hand crank (also not shown) to extend the first and second scissor support arms 24 and 26. As first and second scissor support arms 24 and 26 extend, they push the projected edge support 28 away from the attachment supporting structure, which in turn unrolls the fabric panel 22 from the spindle 18. When the first and second scissor support arms 24 and 26 are fully extended they cantileveredly support the projected edge support 28 and the fabric panel 22. Generally the first and second scissor support arms 24 and 26 extend at a slightly downwardly inclining angle so that the projected edge support 28 is slightly lower than the spindle 18. This allows rain or other debris to more easily roll off the extended fabric panel 22 of the awning 10. The extended fabric panel 22, if interposed between the sun and an object below provides shade for the object. To retract the awning assembly 10 an operator would again engage the electric motor (not shown) or hand crank (also not shown) to retract the first and second scissor support arms 24 and 26, thereby retracting the projected edge support 28. The axle 20 or spindle 18 usually include some type of torsional spring retraction mechanism to roll the fabric panel 22 back up on the spindle as the projected edge support 28 retracts.

Also in FIG. 1 a side shade is generally indicated by reference number 30. In the embodiment of the present invention shown in FIGS. 1, 2, 2A, 2B, and 3 the side shade 30 includes a fabric panel 32 having a first vertical side 34 and a second vertical side 36. In another embodiment of the present invention the fabric panel 32 has a first vertical side 34 and the other side ends in a point, so the fabric panel is triangularly shaped. In various other embodiments of the present invention the fabric panel is rectangular, square, oval or other quadrilateral shapes.

Figure 2:
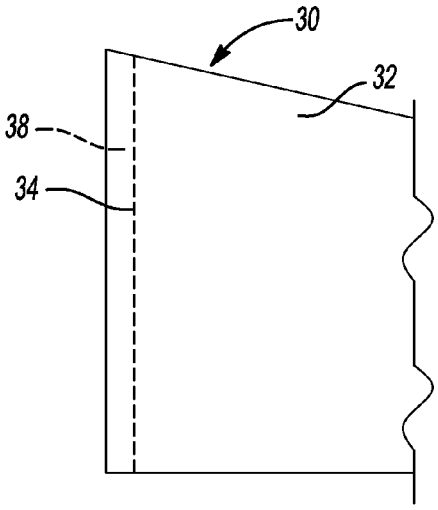
FIG. 2 is a side view of an embodiment of the first vertical side of the side shade in accordance with the present invention.
Figure 3:
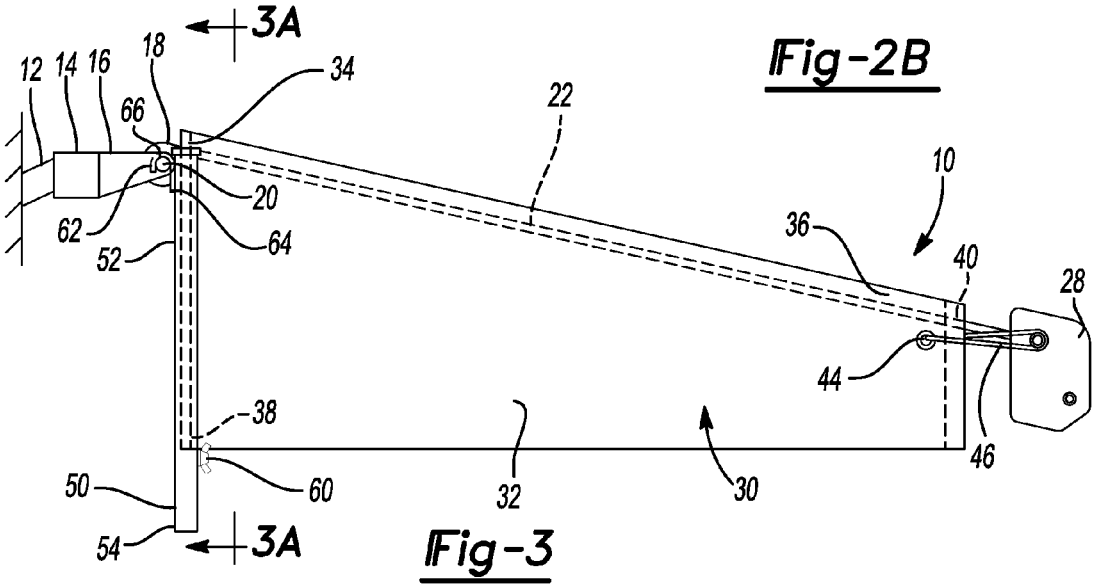
FIG. 3 is a side view of an embodiment of a side shade in accordance with the present invention mounted on an awning.

In the embodiment of the present invention shown in FIGS. 1, 2 and 3 a stiffening member 38 is sewn into a fold of the first vertical side 34 of the fabric panel 32. The stiffening member 38 extends the entire length of the first vertical side 34 of the fabric panel 32 as shown in FIG. 2. In the embodiment of the present invention shown in FIG. 2 the stiffening member 38 is a rod with a circular cross section and is made of plastic. Other embodiments of the present invention include stiffener members 38 with other cross-sectional shapes such as square, rectangular, hexagonal or triangular and materials such as metal (including aluminum, steel, copper, and brass), fiberglass and other composite materials. The stiffening member 38 keeps the first vertical side 34 of the fabric panel 32 straight and does not allow the first vertical side 34 of the fabric panel 32 to sag.

Figure 2A:
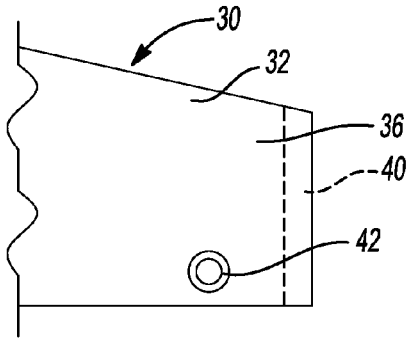
FIG. 2A is a side view of one embodiment of the second vertical side of the side shade in accordance with the present invention.

In the embodiment of the present invention shown in FIGS. 1, 2A, and 3 a second stiffening member 40 is sewn into a fold of the second vertical side 36 of the fabric panel 32. The second stiffening member 40 extends the entire length of the second vertical side 36 of the fabric panel 32 as shown in FIG. 2A. In the embodiment of the present invention shown in FIG. 2A the second stiffening member 40 is a rod with a circular cross section and is made of plastic. Other embodiments of the present invention include second stiffener members 40 with other cross-sectional shapes such as square, rectangular, hexagonal or triangular and materials such as metal (including aluminum, steel, copper, and brass), fiberglass and other composite materials. The second stiffening member 40 keeps the second vertical side 36 of the fabric panel 32 straight and does not allow the second vertical side 36 of the fabric panel 32 to sag.

Figure 2B:
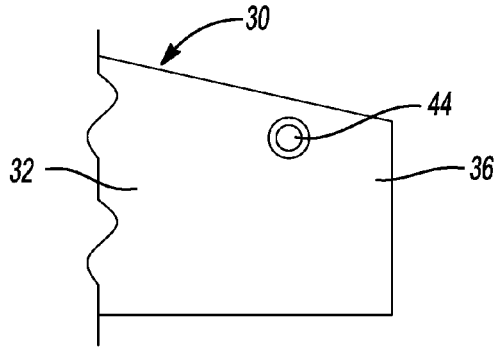
FIG. 2B is a side view of another embodiment of the second vertical side of the side shade in accordance with the present invention.

In the embodiment of the present invention shown in FIGS. 1, 2B, and 3 the second vertical side 36 of the fabric panel 32 also includes a hole or aperture 44 in the upper corner of the fabric panel 32. In the embodiment of the present invention shown in FIGS. 1, 2B, and 3 the hole or aperture 44 includes a reinforcing grommet. In the embodiment of the present invention shown in FIGS. 1, 2A, and 3 a cord 46 is looped through the hole or aperture 44 and reinforcing grommet. In the embodiment of the present invention shown in the figures the cord 46 is an elastic cord 46, but the present invention includes embodiments where the cord 46 is rope, twine, wire, or chain. In the embodiment of the present invention shown in FIG. 2B, where the second vertical side 36 of the fabric panel 32 includes a hole or aperture 44 in the upper corner of the fabric panel, the second vertical side 36 of the fabric panel 32 does not include the second stiffening member 40 as the second vertical side 36 of the fabric panel 32 will hang naturally from an attachment at the hole or aperture 44. In other embodiments of the present invention (as shown in FIGS. 1 and 3) where the second vertical side 36 of the fabric panel 32 includes a hole or aperture 44 in the upper corner of the fabric panel, the second vertical side 36 of the fabric panel 32 also includes the second stiffening member 40.

In the embodiment of the present invention shown in FIG. 2A the second vertical side 36 of the fabric panel 32 also includes a hole or aperture 42 in the lower corner of the fabric panel 32. In the embodiment of the present invention shown in FIG. 2B the hole or aperture 42 includes a reinforcing grommet. In one embodiment of the present invention (not shown) a cord is looped through the hole or aperture 42 and reinforcing grommet. In this embodiment of the present invention the cord is an elastic cord, but the present invention includes embodiments where the cord is rope, twine, wire, or chain. In the embodiment of the present invention shown in FIG. 2A, where the second vertical side 36 of the fabric panel 32 includes the hole or aperture 42 in the lower corner of the fabric pane, the second vertical side 36 of the fabric panel 32 also includes the second stiffening member 40.

In one embodiment of the present invention the side shade 30 includes a mounting member 50. In the embodiment of the present invention shown in FIGS. 1, 3, 3A and 3B the mounting member 50 is an extruded aluminum bar formed with a substantially rectangular cross section, as shown in FIG. 3B. In other embodiments of the present invention the mounting member 50 has square, circular or elliptical cross sections and is made of either another metal (such as stainless steel, galvanized steel, brass or cast iron) or is made of fiberglass, plastic or some composite material. In the embodiment of the present invention shown in FIGS. 1, 3, 3A and 3B the mounting member 50 has a top end 52, a bottom end 54, and a vertical groove 56 extending from the top end 52 to the bottom end 54, as shown in FIGS. 1, 3, 3A and 3B. The vertical groove 56 is open at both the top end 52 and the bottom end 54 of the mounting member 50, has a lateral opening 57 along one side of the mounting member 50, making the mounting member 50 substantially shaped like a C channel bar. The first vertical side 34 of the fabric panel 32 with the stiffening member 38 slides into the vertical groove 56 of the mounting member 50 from the top end 52 or the bottom end 54 of the mounting member 50.

In the embodiment of the present invention shown in FIGS. 1, 3, 3A and 3B a hook 62 is attached to the top end 52 of the mounting member 50. The hook 62 is made of the same material as is the mounting member 52, in this case aluminum. The hook 62 includes a substantially straight portion 64 and a curved portion 66. The substantially curved portion 66 of the hook 62 inscribes an arc sized to fit over the axle 20 of the awning 10 when the awning 10 is fully extended. In the In the embodiment of the present invention shown in FIGS. 1 and 3 the hook 62 is welded to the mounting member 50 on a side opposite the lateral opening 57 of the vertical groove 56. In other embodiments of the present invention the hook 62 is attached to the mounting member 50 on a side adjacent the lateral opening 57 of the vertical groove 56 and is attached by other fastenings such as screws, bolts, solder or adhesive or is integrally formed with the mounting member 50. The hook 62 fits over the axle 20 of the awning 10 to hold the mounting member 50 in place relative to the awning 10.

A locking member 58 is disposed inside the vertical groove 56 of the mounting member 50. In the embodiment of the present invention shown in FIGS. 1, 3, 3A and 3B the locking member 58 is a doughnut shaped metal ring sized to fit within the cross section of the vertical groove 56 but the locking member 58 is large enough to not fit through the lateral opening 57 of the vertical groove 56. The locking member 58 has a threaded hole or aperture into which a wing bolt 60 is threaded. The head of the wing bolt 60 is wider than the lateral opening 57 of the vertical groove 56. In this embodiment of the present invention the locking member 58 and wing bolt 60 are made of stainless steel, but in other embodiments of the invention the locking member 58 and wing bolt 60 can be galvanized steel, brass or plastic. The locking member 58 is slidingly disposed within the vertical groove below the first vertical side 34 of the fabric panel 32 with the stiffening member 38. When the wing bolt 60 is tightened, the locking member 58 and wing bolt 60 compress against the sides of the lateral opening 57 of the vertical groove 56 and lock in place. The locking member 58 thereby vertically supports the first vertical side 34 of the fabric panel 32 and the stiffening member 38. In other embodiments of the present invention the locking member 58 and wing bolt 60 are replaced by other locking member/securing member combinations, such as: a nut acting as the locking member and a wing bolt acting as the securing member; a round headed bolt acting as the locking member and a wing nut acting as the securing member; a flat metal plate with a threaded hole or aperture acting as the locking member and a wing bolt acting as the securing member, or some other suitable attachment.

The operator chooses how high to position the fabric panel 32 and stiffening member 38 in relation to the mounting member by adjusting the vertical position of the locking member 58 and wing bolt 60. The higher the locking member 58 is positioned in the groove 56, the higher the locking member 58 will hold the first vertical side 34 of the fabric panel 32 and stiffening member 38.

To mount the side shade 30 an operator hangs the hook 62 of the mounting member 50 on the awning assembly 10. In the embodiment of the present invention shown in FIGS. 1 and 3 the operator hangs the hook 62 over the axle 20. However, in other embodiments of the present invention the hook 62 can mount on one of the mounting brackets 12, the torsion bar 14, a connecting bracket 16, or the spindle 18 as necessary. Also, in other embodiments of the present invention the mounting member 50 could also mount to any of the mounting bracket 12, torsion bar 14, connecting bracket 16, spindle 18 or axle 20 by any suitable mounting means other than the hook 62.

The operator next attaches the second vertical side 36 of the fabric panel 32 by looping the cord 46 around a projecting screw, as shown in FIGS. 1 and 3. In other embodiments of the present invention the second vertical side 36 of the fabric panel 32 attaches to the projected edge support 28 or one of the first or second scissor support arms 24 or 26 by means of a hook, projecting rod, screw or other suitable projecting mechanism onto which the operator can slip the cord 46, the hole or aperture 42 or the hole or aperture 44 (depending on how the fabric panel 32 is configured). In the embodiment of the present invention shown in FIGS. 1 and 3 the elastic cord 46 provides horizontal tension in the fabric panel 32 of the side shade 30 and helps hold the side shade 30 in place.

When the side shade 30 is properly mounted the top portion of the fabric panel 32 of the side shade 30 is at least vertically even with, if not vertically above, the fabric panel 22 of the awning. This will prevent the formation of any side vertical gap between the side shade 30 and the awning 10. If the top portion of the fabric panel 32 is too low and a vertical gap exists between the side shade 30 and the awning 10, the operator loosens the wing bolt 60 and raise the locking member 58, thereby raising the first vertical side 34 of the fabric panel 32 and the stiffening member 38 in the groove 56 of the mounting member 50. When the fabric panel 32 is at the proper height, the operator tightens the wing bolt 60 and locks the locking member 58, the fabric panel 32 and the stiffening member 38 in place. Conversely, if the top portion of the fabric panel 32 is too high and the side shade 30 does not provide adequate side shading, the operator loosens the wing bolt 60 and lowers the locking member 58, thereby allowing the first vertical side 34 of the fabric panel 32 and the stiffening member 38 to move and be lowered in the groove 56 of the mounting member 50. Again, when the fabric panel 32 is at the proper height, the operator tightens the wing bolt 60 and locks the locking member 58, the fabric panel 32 and the stiffening member 38 in place. If the operator so chooses he can also raise or lower the fabric panel 32 for aesthetic reasons, such as making the lower edge of the fabric panel perfectly horizontal or angled to match the downward angle of inclination of the awning.

When the operator wants to remove the side shade, the operator removes the cord 46 from the projecting screw. The operator then unhooks the hook 62 of the mounting member 50 from the axle 20 of the awning 10 and proceeds to roll the fabric panel 32 around the mounting member 50 for storage. Rolling the fabric panel 32 around the mounting member 50 allows the side shade 30 to store more neatly and take up less space than if the fabric panel was not rolled around the mounting member 50.

Figure 4:
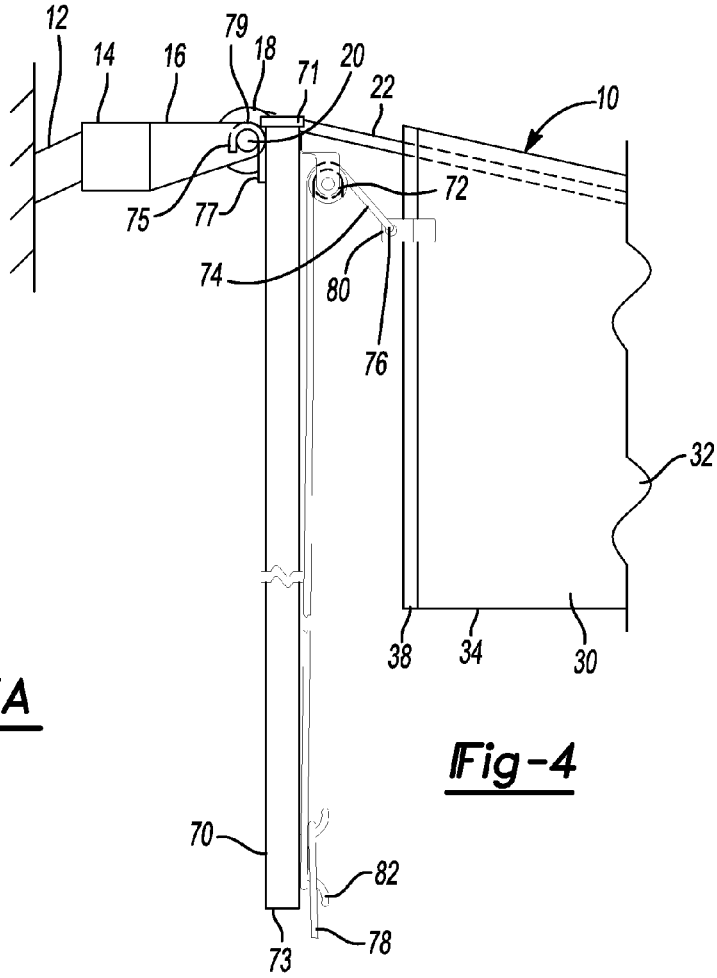
FIG. 4 is side view of another embodiment of a side shade in accordance with the present invention mounted on an awning showing just the portion of the side-shade and awning near the mounting portion of the awning.

In another embodiment of the present invention the side shade 30 includes a mounting member 70. In the embodiment of the present invention shown in FIG. 4 the mounting member 70 is an extruded aluminum bar formed with a substantially rectangular cross section. In other embodiments of the present invention the mounting member 50 has square, circular or elliptical cross sections and is made of either another metal (such as stainless steel, galvanized steel, brass or cast iron) or is made of fiberglass, plastic or some composite material. In the embodiment of the present invention shown in FIG. 1, 4 the mounting member 50 has a top end 71, a bottom end 73 and end caps at each of the top end 71 and bottom end 73. In the embodiment of the present invention shown in FIG. 4 the end caps are plastic, but in other embodiments of the present invention include the end caps that are aluminum, stainless steel, galvanized steel, brass, cast iron, fiberglass, or composite material.

A pulley 72 is attached near the top end 52 of the mounting member 70. In the embodiment of the present invention shown in FIG. 4 the pulley 72 is made of aluminum and has a pulley wheel supported on a rotating axis by a u-shaped guard section. The u-shaped guard section is attached by a swivel to an oval mounting plate. The oval mounting plate is attached to the mounting member 70 by a screw that passes through the mounting plate of the pulley 72 and screws into a threaded hole or aperture in the top end 71 of the mounting member 70. Other embodiments of the present invention include pulleys of different configurations and mounting arrangements.

A hook 75 is attached to the top end 71 of the mounting member 70. The hook 75 is made of the same material as is the mounting member 52, in this case aluminum. The hook 75 includes a substantially straight portion 77 and a curved portion 79. The curved portion 77 of the hook 79 inscribes an arc sized to fit over the axle 20 of the awning 10 when the awning 10 is fully extended. In the In the embodiment of the present invention shown in FIGS. 1 and 3 the hook 75 is welded to the mounting member 70 on a side opposite the pulley 72. In other embodiments of the present invention the hook 75 is attached to the mounting member 70 on a side adjacent the pulley 72 and is attached by other fastenings such as screws, bolts, solder or adhesive or is integrally formed with the mounting member 50. The hook 75 fits over the axle 20 of the awning to hold the mounting member 70 in place relative to the awning 10.

The mounting member also has a cleat 82 attached at the lower end of the mounting member. In the embodiment of the present invention shown in FIG. 4 the cleat 82 is stainless steel, has a pair of opposed arms and has two holes in a mid-positioned mounting section. The cleat 82 is attached to the mounting member 70 by a pair of screws that pass through the two holes in the mid-positioned mounting section of the cleat and thread into threaded holes in the bottom end 73 of the mounting member 70.

A cord 74 having a first end 76 and a second end 78 runs through the pulley 72, passing over and around the wheel of the pulley 72 and held in place by the u-shaped guard section of the pulley. In the embodiment of the present invention shown in FIG. 4 the cord 74 is a woven nylon line. In other embodiments of the present invention the cord 74 is various other flexible members such rope, wire, light chain, heavy string, or the like.

A clip 80 is fixedly attached to the first end 76 of the cord 74. In the embodiment of the present invention shown in FIG. 4 the clip 80 is an alligator clip and the first end 76 of the cord 74 is tied to the clip. In other embodiments of the present invention the clip is various other types of clips or clamps such as a pony clip, a spring clamp or the sort. The clip 80 removably clips to the first vertical side 34 of the fabric panel 32 (which includes the stiffening member 38).

To mount the side shade 30 an operator hangs the hook 75 of the mounting member 70 on the awning assembly 10. In the embodiment of the present invention shown in FIG. 4 the operator hangs the hook 75 over the axle 20. However, in other embodiments of the present invention the hook 75 mounts on one of the mounting brackets 12, the torsion bar 14, a connecting bracket 16, or the spindle 18 as necessary. The mounting member 70 could also mount to any of the mounting bracket 12, torsion bar 14, connecting bracket 16, spindle 18 or axle 20 by any suitable mounting means other than the hook 75.

The operator next attaches the second vertical side 36 of the fabric panel 32 by looping the cord 46 around a projecting screw. In other embodiments of the present invention the second vertical side 36 of the fabric panel 32 attaches to the projected edge support 28 or one of the first or second scissor support arms 24 or 26 by means of a hook, projecting rod, screw or other suitable projecting mechanism onto which the operator can slip the cord 46, the hole or aperture 42 or the hole or aperture 44 (depending on how the fabric panel 32 is configured). In this embodiment of the present invention the elastic cord 46 provides horizontal tension in the fabric panel 32 of the side shade 30 and helps hold the side shade 30 in place.

The operator chooses how high to position the fabric panel 32 and stiffening member 38 by pulling the cord 74 to raise the fabric panel 34 and stiffening member 38 in relation to the mounting member 70 or releasing the cord 74 to lower the fabric panel 34 in relation to the mounting member 70. If the operator needs to make a larger adjustment, the operator repositions the clip 80 upwards or downwards on the first vertical side 34 of the fabric panel 34 and then again pull or release the cord 74. The operator ties off the second end 78 of the cord 74 to the cleat 82 to hold the cord 74, and therefore also the first vertical side 34 of the fabric panel 34, in place.

When the side shade 30 is properly mounted, the top portion of the fabric panel 32 of the side shade 30 is at least vertically even with, if not vertically above, the fabric panel 22 of the awning. This will prevent the formation of any side vertical gap between the side shade 30 and the awning 10. If the top portion of the fabric panel 32 is too low and a vertical gap exists between the side shade 30 and the awning 10, the operator unties the second end 78 of the cord 74 from the cleat 82 and pulls on cord 74 to raise the first end 76 of the cord, thereby raising the first vertical side 34 of the fabric panel 32 and the stiffening member 38 in relation to the mounting member 70 and awning 10. When the fabric panel 32 is at the proper height, the operator reties the second end 78 of the cord 74 to the cleat 82 to hold the fabric panel 32 and the stiffening member 38 in place. Conversely, if the top portion of the fabric panel 32 is too high and the side shade 30 does not provide adequate side shading, the operator unties the second end 78 of the cord 74 from the cleat 82 and releases the cord 74 to lower the first end 76 of the cord, thereby lowering the first vertical side 34 of the fabric panel 32 and the stiffening member 38 in relation to the mounting member 70 and awning 10. Again, when the fabric panel 32 is at the proper height, the operator reties the second end 78 of the cord 74 to the cleat 82 to hold the fabric panel 32 and the stiffening member 38 in place. If the operator so chooses he can also raise or lower the fabric panel 32 for aesthetic reasons, such as making the lower edge of the fabric panel perfectly horizontal or angled to match the downward angle of inclination of the awning.

When the operator wants to remove the side shade, the operator removes the cord 46, hole or aperture 42 or hole or aperture 44 of the second vertical side 36 of the fabric panel 32 from the connection to the projected edge support 28 or one of the first or second scissor support arms 24 or 26. The operator then unhooks the hook 62 of the mounting member 70 from the awning and proceeds to roll the fabric panel 32 around the mounting member 70 for storage. Rolling the fabric panel 32 around the mounting member 70 allows the side shade 30 to store more neatly and take up less space than if the fabric panel was not rolled around the mounting member 70.

In yet another embodiment of the present invention the side shade 30 includes a mounting member 90. In the embodiment of the present invention shown in FIG. 5 the mounting member 90 is an extruded aluminum bar formed with a substantially rectangular cross section. In other embodiments of the present invention the mounting member 90 has square, circular or elliptical cross sections and is made of either another metal (such as stainless steel, galvanized steel, brass or cast iron) or is made of fiberglass, plastic or some composite material. In the embodiment of the present invention shown in FIG. 5 the mounting member 90 has a top end 91, a bottom end 93, and a vertical groove extending from the top end 91 to the bottom end 93. The vertical groove in mounting bar 90 is similar to the vertical groove 56 in mounting bar 50 of the embodiment shown in FIGS. 1, 3 and 3A and has a lateral opening along one side of the mounting member 90, making the mounting member substantially shaped like a C channel bar. In the embodiment shown in FIG. 5 the lateral opening is narrower than the combination of the first vertical side 34 of the fabric panel 32 and the stiffening member 38 so that when the first vertical side 34 of the fabric panel 32 with the stiffening member 38 slides into the vertical groove of the mounting member 90, from the top end 91 or the bottom end 93 of the mounting member 90, the first vertical side 34 of the fabric panel 32 with the stiffening member 38 is held in place by the lateral opening and a pair of end caps on the top end 91 and the bottom end 93 of the mounting member 90. In the embodiment of the present invention shown in FIG. 5 the end caps are plastic, but other embodiments of the present invention have aluminum, stainless steel, galvanized steel, brass, cast iron, fiberglass, or composite material end caps. In other embodiments of the present invention the mounting member 90 does not have a groove and the first vertical side 34 of the fabric panel 32 does slide not include a stiffening member 38. Instead first vertical side 34 of the fabric panel 32 is attached to a lateral support of the mounting member 90 by other fastening means, such as screws or adhesive.

The mounting member also has a cleat 96 attached at the bottom end 93 of the mounting member 90. In the embodiment of the present invention shown in FIG. 5 the cleat 96 is stainless steel, has a pair of opposed arms and has two holes in a mid-positioned mounting section. The cleat 96 is attached to the mounting member 90 by a pair of screws that pass through the two holes in the mid-positioned mounting section of the cleat and thread into threaded holes in the bottom end 93 of the mounting member 90.

A pulley 92 is attached to one of the connecting brackets 16 of the awning 10. In the embodiment of the present invention shown in FIG. 5 the pulley 92 is made of aluminum and has a pulley wheel supported on a rotating axis by a u-shaped guard section. The u-shaped guard section is attached by a swivel to an oval mounting plate. The oval mounting plate is attached to the connecting bracket 16 by a screw that passes through the mounting plate of the pulley 92 and screws into a threaded hole in the connecting bracket 16. Other embodiments of the present invention include pulleys of different configurations and embodiments where the pulley is connected to a mounting bracket 12, the torsion bar 16, the spindle 18 or the axle 20 of the awning.

A cord 94 having a first end 98 and a second end 99 is attached to the mounting member. In the embodiment of the present invention shown in FIG. 5 the cord 94 is a woven nylon line. In other embodiments of the present invention the cord 94 is various other flexible members such rope, wire, light chain, heavy string, or the like. The first end 98 of the cord is tied to a bracket that is screwed to the mounting member 90. The bracket is located slightly below the top end 91 of the mounting member 90.

To mount the side shade 30 the operator runs the second end 99 of the cord 94 through the pulley 92, passing the cord 94 over and around the wheel of the pulley 92 to be held in place by the u-shaped guard section of the pulley. The operator ties the second end 99 of the cord 94 to the cleat 96, thereby securing the mounting member 90 to the awning.

The operator next attaches the second vertical side 36 of the fabric panel 32 by looping the cord 46 around a projecting screw. In other embodiments of the present invention the second vertical side 36 of the fabric panel 32 attaches to the projected edge support 28 or one of the first or second scissor support arms 24 or 26 by means of a hook, projecting rod, screw or other suitable projecting mechanism onto which the operator can slip the cord 46, the hole or aperture 42 or the hole or aperture 44 (depending on how the fabric panel 32 is configured). In this embodiment of the present invention the elastic cord 46 provides horizontal tension in the fabric panel 32 of the side shade 30 and helps hold the side shade 30 in place.

The operator chooses how high to position the fabric panel 32 and mounting member by pulling the cord 94 to raise the fabric panel 34 and mounting member 90 in relation to the awning 10 or releasing the cord 94 to lower the fabric panel 34 and mounting member 90 in relation to the awning 10.

When the side shade 30 is properly mounted, the top portion of the fabric panel 32 of the side shade 30 is at least vertically even with, if not vertically above, the fabric panel 22 of the awning. This will prevent the formation of any side vertical gap between the side shade 30 and the awning 10. If the top portion of the fabric panel 32 is too low and a vertical gap exists between the side shade 30 and the awning 10, the operator unties the cord 94 from the cleat 96, and pulls on the cord 94 to raise the first vertical side 34 of the fabric panel 32 and the mounting member 90 in relation to the awning 10. When the fabric panel 32 is at the proper height, the operator reties the cord 94 to the cleat 96 to hold the fabric panel 32 and the mounting member 90 in place. Conversely, if the top portion of the fabric panel 32 is too high and the side shade 30 does not provide adequate side shading, the operator unties the cord 94 from the cleat 96 and releases the cord 94 to lower the first vertical side 34 of the fabric panel 32 and the mounting member 90 in relation to the awning 10. Again, when the fabric panel 32 is at the proper height, the operator reties the cord 94 to the cleat 96 to hold the fabric panel 32 and the mounting member 90 in place. If the operator so chooses he can also raise or lower the fabric panel 32 for aesthetic reasons, such as making the lower edge of the fabric panel perfectly horizontal or angled to match the downward angle of inclination of the awning.

When the operator wants to remove the side shade, the operator removes the cord 46, hole or aperture 42 or hole or aperture 44 of the second vertical side 36 of the fabric panel 32 from the connection to the projected edge support 28 or one of the first or second scissor support arms 24 or 26. The operator then unties the cord 94 from the cleat 96, pulls the cord 94 all of the way through the pulley 92 to remove the mounting member 90 from the awning and proceeds to roll the fabric panel 32 around the mounting member 90 for storage. Rolling the fabric panel 32 around the mounting member 90 allows the side shade 30 to store more neatly and take up less space than if the fabric panel was not rolled around the mounting member 90.

In still another embodiment of the present invention the side shade 30 includes a mounting member 100. In the embodiment of the present invention shown in FIG. 6 the mounting member 100 is an extruded aluminum bar formed with a substantially rectangular cross section. In other embodiments of the present invention the mounting member 100 has square, circular or elliptical cross sections and is made of either another metal (such as stainless steel, galvanized steel, brass or cast iron) or is made of fiberglass, plastic or some composite material. In the embodiment of the present invention shown in FIG. 6 the mounting member 100 has a top end 101, a bottom end 103, and a vertical groove extending from the top end 101 to the bottom end 103.

Figure 3A:
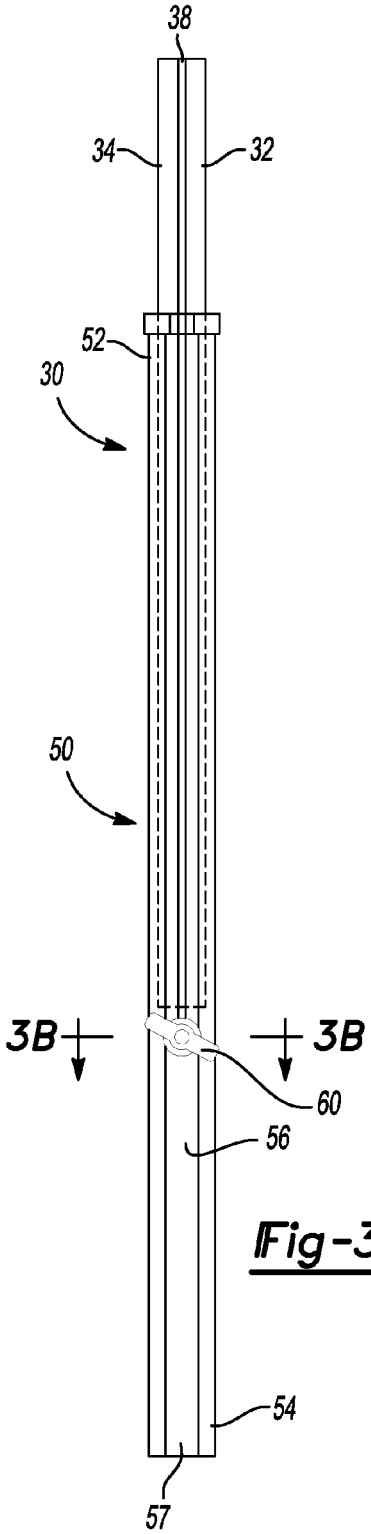
FIG. 3A is front view of an embodiment of a side shade in accordance with the present invention showing a mounting member, stiffening member and frictional lock according to one embodiment of the present invention.
Figure 3B:
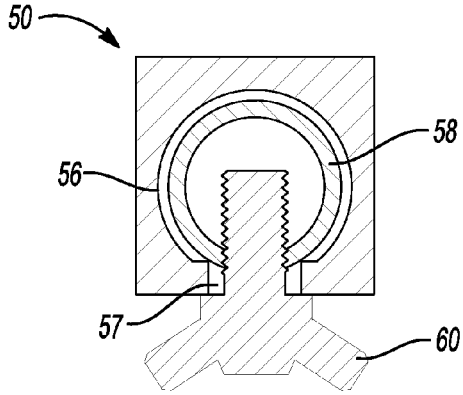
FIG. 3B is top cross-sectional view of an embodiment of a side shade in accordance with the present invention showing a mounting member, stiffening member and frictional lock according to one embodiment of the present invention.

The vertical groove in mounting bar 100 is similar to the vertical groove 56 in mounting bar 50 of the embodiment shown in FIGS. 1, 3 and 3A and has a lateral opening along one side of the mounting member 100, making the mounting member substantially shaped like a C channel bar. The lateral opening is narrower than the combination of the first vertical side 34 of the fabric panel 32 and the stiffening member 38 so that when the first vertical side 34 of the fabric panel 32 with the stiffening member 38 slides into the vertical groove of the mounting member 100, from the top end 101 or the bottom end 103 of the mounting member 90, the first vertical side 34 of the fabric panel 32 with the stiffening member 38 is held in place by the lateral opening and a pair of end caps on the top end 101 and the bottom end 103 of the mounting member 90. In the embodiment of the present invention shown in FIG. 6 the end caps are plastic, but other embodiments of the present invention have aluminum, stainless steel, galvanized steel, brass, cast iron, fiberglass, or composite material end caps. In other embodiments of the present invention the mounting member 100 does not have a groove and the first vertical side 34 of the fabric panel 32 does slide not include a stiffening member 38. Instead first vertical side 34 of the fabric panel 32 is attached to a lateral support of the mounting member 100 by screws, adhesive or other fastening.

The mounting member 100 has a plurality of loops 102 attached from the top end 101 of the mounting member 100 downwards towards the bottom end 103 of the mounting member 100, as shown in FIG. 6.

A hook 104 is attached to one of the connecting brackets 16 of the awning 10. In the embodiment of the present invention shown in FIG. 6 the hook 104 is extruded aluminum and is attached to the connecting brackets by a pair of screws. Other embodiments of the present invention include hooks 104 made of different materials such as cast aluminum, stainless steel, galvanized steel, brass or cast iron and where the hook 104 is connected to either a mounting bracket 12, the torsion bar 16, the spindle 18 or the axle 20 of the awning.

To mount the side shade 30 the operator hangs one of the plurality of loops 102 on the hook 104. The operator next attaches the second vertical side 36 of the fabric panel 32 by looping the cord 46 around a projecting screw. In other embodiments of the present invention the second vertical side 36 of the fabric panel 32 attaches to the projected edge support 28 or one of the first or second scissor support arms 24 or 26 by means of a hook, projecting rod, screw or other suitable projecting mechanism onto which the operator can slip the cord 46, the hole or aperture 42 or the hole or aperture 44 (depending on how the fabric panel 32 is configured). In this embodiment of the present invention the elastic cord 46 provides horizontal tension in the fabric panel 32 of the side shade 30 and helps hold the side shade 30 in place. The operator chooses how high to position the fabric panel 32 and mounting member by choosing which loop 102 to hang on the hook 104, thereby adjusting the height of the mounting member 100 and fabric panel 32 relative to the awning 10.

When the side shade 30 is properly mounted, the top portion of the fabric panel 32 of the side shade 30 is at least vertically even with, if not vertically above, the fabric panel 22 of the awning. This will prevent the formation of any side vertical gap between the side shade 30 and the awning 10. If the top portion of the fabric panel 32 is too low and a vertical gap exists between the side shade 30 and the awning 10, the operator lifts the mounting member 100 and removes the loop 102 from the hook 104 and then hangs the mounting member 100 on a loop 102 lower on the mounting member 100, thereby raising the first vertical side 34 of the fabric panel 32 and the mounting member 100 in relation to the awning 10. Conversely, if the top portion of the fabric panel 32 is too high and the side shade 30 does not provide adequate side shading, the operator lifts the mounting member 100 and removes the loop 102 from the hook 104 and then hangs the mounting member 100 from a loop 102 higher on the mounting member 100, thereby lowering the first vertical side 34 of the fabric panel 32 and the mounting member 90 in relation to the awning 10. If the operator so chooses he can also raise or lower the fabric panel 32 for aesthetic reasons, such as making the lower edge of the fabric panel perfectly horizontal or angled to match the downward angle of inclination of the awning.

When the operator wants to remove the side shade, the operator removes the cord 46, hole or aperture 42 or hole or aperture 44 of the second vertical side 36 of the fabric panel 32 from the connection to the projected edge support 28 or one of the first or second scissor support arms 24 or 26. The operator then lifts the mounting member 100, unhooks the loop 102 from the hook 104 to remove the mounting member 100 from the awning and proceeds to roll the fabric panel 32 around the mounting member 100 for storage. Rolling the fabric panel 32 around the mounting member 100 allows the side shade 30 to store more neatly and take up less space than if the fabric panel was not rolled around the mounting member 100.

While the best modes for carrying out the invention have been described in detail, those familiar with the art to which this invention relates will recognize various alternative designs and embodiments for practicing the invention within the scope of the appended claims.

What is claimed is:

1. A side shade assembly for an awning, the awning having an attachment support, a projected edge support, and a predominantly horizontal panel with at least one lateral side and disposed between the attachment support and the projected edge support, the side shade assembly comprising:

a fabric panel having a first vertical side and a top portion;

a stiffening member for supporting the first vertical side of the fabric panel;

a mounting member having a top end, a bottom end and a vertical groove extending between the top end and the bottom end, wherein the top end of the mounting member is removably connectable proximate the attachment support of the awning and wherein at least a portion of the stiffening member and the first vertical side of the fabric panel is slidingly disposed within the vertical groove of the mounting member;

a locking member abutting the stiffening member and disposed in the vertical groove of the mounting member and releasably connectable to the mounting member at a first location to position the top portion of the first vertical side of the fabric panel above the at least one lateral side of the predominantly horizontal panel, and a wing bolt, wherein the wing bolt releasably connects the locking member to the mounting member.

2. The side panel assembly according to claim 1 further comprising a hook fixedly attached to the top end of the mounting member, wherein the hook at the top end of the mounting member is removably connectable proximate the attachment support of the awning.

3. The side panel assembly according to claim 1 wherein the fabric panel has a second vertical side opposite the first vertical side of the fabric panel, wherein the second vertical side of the fabric panel is removably connectable proximate the projected edge support of the awning.

4. The side panel assembly according to claim 1 wherein the locking member has a second location abutting the stiffening member to position the top portion of the first vertical side of the fabric panel below the at least one lateral side of the predominantly horizontal panel.

5. The side panel assembly according to claim 4 wherein the locking member has a third position in the groove abutting the stiffening member to position the top portion of the first vertical side of the fabric panel adjacent the at least one lateral side of the predominantly horizontal panel.

6. A side shade assembly for an awning, the awning having an attachment support, a projected edge support, and a predominantly horizontal panel with at least one lateral side and disposed between the attachment support and the projected edge support, the side shade assembly comprising:

a fabric panel having a first vertical side, a second vertical side and a top portion, wherein the second vertical side of the fabric panel is removably connectable proximate the projected edge support;

a stiffening member connected to the first vertical side of the fabric panel;

a mounting member having a top end, a bottom end and a vertical groove extending between the top end and the bottom end, wherein at least a portion of the stiffening member and the first vertical side of the fabric panel is slidingly disposed within the vertical groove of the mounting member;

a hook fixedly connected at the top end of the mounting member, wherein the hook at the top end of the mounting member is removably connectable proximate the attachment support of the awning;

a locking member disposed in the vertical groove of the mounting member, abutting the stiffening member and releasably connectable to the mounting member in at least a first position, a second position and a third position; and a wing bolt, wherein the wing bolt releasably connects the locking member to the mounting member; and wherein the top portion of the first vertical side of the fabric panel is above the lateral side of the predominantly horizontal panel when the locking member is in the first position, the top portion of the first vertical side of the fabric panel is below the at least one lateral side of the predominantly horizontal panel when the locking member is in the second position and the top portion of the first vertical side of the fabric panel is adjacent the at least one lateral side of the predominantly horizontal panel when the locking member is in the third position.

7. The side panel assembly according to claim 6 wherein the second vertical side includes an aperture, wherein the aperture is removably connectable proximate the projected edge support of the awning.

8. The side panel assembly according to claim 6 further comprising a loop connected to the second vertical side of the fabric panel, wherein the loop is removably connectable proximate the projected edge support of the awning.

9. The side panel assembly according to claim 6 further comprising a second stiffening member connected to the second vertical side of the fabric panel.

* * * * *